US008794153B2

(12) United States Patent
Glenn

(10) Patent No.: US 8,794,153 B2
(45) Date of Patent: Aug. 5, 2014

(54) SHAPED CHARGE LINER COMPRISED OF REACTIVE MATERIALS

(75) Inventor: Corbin S. Glenn, Burleson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/463,458

(22) Filed: May 3, 2012

(65) Prior Publication Data

US 2012/0234194 A1 Sep. 20, 2012

Related U.S. Application Data

(62) Division of application No. 12/720,522, filed on Mar. 9, 2010, now Pat. No. 8,381,652.

(51) Int. Cl.
*F42B 1/032* (2006.01)
*E21B 43/117* (2006.01)
*F42B 1/028* (2006.01)

(52) U.S. Cl.
CPC ..... *F42B 1/028* (2013.01); *F42B 1/032* (2013.01)
USPC ..... 102/306; 102/307

(58) Field of Classification Search
CPC ..... F42B 1/02; F42B 1/028; F42B 1/032; F42B 3/08; E21B 43/116; E21B 43/117
USPC ..... 102/306, 307, 308, 309, 310, 476; 89/1.15
See application file for complete search history.

(56) References Cited

U.S. PATENT DOCUMENTS

| | | | |
|---|---|---|---|
| 3,375,108 | A | 3/1968 | Wyman, Sr. et al. |
| 3,924,510 | A | 12/1975 | Strunk et al. |
| 4,220,687 | A | 9/1980 | Christopher |
| 4,290,486 | A | 9/1981 | Regalbuto |
| 5,098,487 | A | 3/1992 | Brauer et al. |
| 5,295,545 | A | 3/1994 | Passamaneck |
| 5,775,426 | A | 7/1998 | Snider et al. |
| 6,158,511 | A | 12/2000 | Wesson |
| 6,263,283 | B1 | 7/2001 | Snider et al. |
| 6,336,506 | B2 | 1/2002 | Wesson |
| 6,347,673 | B1 | 2/2002 | Dailey |
| 6,349,649 | B1 | 2/2002 | Jacoby et al. |
| 6,378,438 | B1 | 4/2002 | Lussier et al. |
| 6,386,288 | B1 | 5/2002 | Snider et al. |
| 6,446,719 | B2 | 9/2002 | Ringgenberg et al. |
| 6,446,720 | B1 | 9/2002 | Ringgenberg et al. |
| 6,527,052 | B2 | 3/2003 | Ringgenberg et al. |

(Continued)

FOREIGN PATENT DOCUMENTS

DE 102005059934 A1 8/2006

OTHER PUBLICATIONS

Notice of Allowance dated Nov. 9, 2012, U.S. Appl. No. 12/512,530, filed Jul. 30, 2009.

(Continued)

*Primary Examiner* — James Bergin

(57) ABSTRACT

A shaped charge liner comprises a powder, and the powder comprises a blend of particles. The particles comprise a core material, a first reactant material in intimate contact with the core material, and a second reactant material in intimate contact with the first reactant, where the core material has a density greater than 10 grams per cubic centimeter (g/cc).

18 Claims, 4 Drawing Sheets

(56) References Cited

U.S. PATENT DOCUMENTS

| | | | | |
|---|---|---|---|---|
| 6,536,524 | B1 | 3/2003 | Snider | |
| 6,543,538 | B2 | 4/2003 | Tolman et al. | |
| 6,554,081 | B1 | 4/2003 | Brooks et al. | |
| 6,598,682 | B2 | 7/2003 | Johnson et al. | |
| 6,732,798 | B2 | 5/2004 | Johnson et al. | |
| 6,840,178 | B2 | 1/2005 | Collins et al. | |
| 6,874,579 | B2 | 4/2005 | Johnson et al. | |
| 6,896,059 | B2 | 5/2005 | Brooks et al. | |
| 6,966,377 | B2 | 11/2005 | Johnson et al. | |
| 7,011,027 | B2 | 3/2006 | Reese et al. | |
| 7,036,594 | B2 | 5/2006 | Walton et al. | |
| 7,182,138 | B2 | 2/2007 | Behrmann et al. | |
| 7,243,725 | B2 | 7/2007 | George et al. | |
| 7,284,612 | B2 | 10/2007 | Ratanasirigulchai et al. | |
| 7,287,589 | B2 | 10/2007 | Grove et al. | |
| 7,393,423 | B2 | 7/2008 | Liu | |
| 7,428,921 | B2 | 9/2008 | Grove et al. | |
| 7,451,819 | B2 | 11/2008 | Chang et al. | |
| 7,533,722 | B2 | 5/2009 | George et al. | |
| 7,571,768 | B2 | 8/2009 | Cuthill | |
| 7,621,332 | B2 | 11/2009 | Haney et al. | |
| 7,712,416 | B2 | 5/2010 | Pratt et al. | |
| 7,753,117 | B2 | 7/2010 | Ramakrishnan et al. | |
| 7,905,285 | B2 | 3/2011 | Cuthill | |
| 7,913,603 | B2 | 3/2011 | LaGrange et al. | |
| 7,913,761 | B2 | 3/2011 | Pratt et al. | |
| 8,156,871 | B2 | 4/2012 | Behrmann et al. | |
| 8,166,882 | B2 * | 5/2012 | Yang | 102/476 |
| 8,220,394 | B2 * | 7/2012 | Bates et al. | 102/476 |
| 8,336,437 | B2 | 12/2012 | Barlow et al. | |
| 8,381,652 | B2 | 2/2013 | Glenn | |
| 8,449,798 | B2 | 5/2013 | Walker | |
| 8,505,454 | B2 * | 8/2013 | Boyer et al. | 102/306 |
| 8,544,563 | B2 * | 10/2013 | Bourne et al. | 175/4.6 |
| 8,555,764 | B2 | 10/2013 | Le et al. | |
| 2002/0178962 | A1 | 12/2002 | Reese et al. | |
| 2003/0131749 | A1 | 7/2003 | Lussier | |
| 2004/0089449 | A1 | 5/2004 | Walton et al. | |
| 2005/0011395 | A1 | 1/2005 | Langan | |
| 2006/0118303 | A1 | 6/2006 | Schultz et al. | |
| 2006/0266551 | A1 | 11/2006 | Yang et al. | |
| 2007/0034369 | A1 | 2/2007 | Ratanasirigulchai et al. | |
| 2007/0158109 | A1 | 7/2007 | Zazovsky et al. | |
| 2008/0034951 | A1 | 2/2008 | Evans et al. | |
| 2008/0289529 | A1 | 11/2008 | Schilling | |
| 2009/0050321 | A1 | 2/2009 | Rhodes et al. | |
| 2009/0078144 | A1 | 3/2009 | Behrmann et al. | |
| 2009/0078420 | A1 | 3/2009 | Caminari et al. | |
| 2009/0084552 | A1 | 4/2009 | Behrmann et al. | |
| 2009/0183916 | A1 | 7/2009 | Pratt et al. | |
| 2010/0096136 | A1 | 4/2010 | Bourne et al. | |
| 2010/0132945 | A1 | 6/2010 | Bell et al. | |
| 2010/0133005 | A1 | 6/2010 | Bell et al. | |
| 2010/0230104 | A1 | 9/2010 | Nölke et al. | |
| 2011/0000669 | A1 | 1/2011 | Barlow et al. | |
| 2011/0155013 | A1 | 6/2011 | Boyer et al. | |
| 2011/0209871 | A1 | 9/2011 | Le et al. | |
| 2011/0219978 | A1 | 9/2011 | Glenn | |
| 2012/0027883 | A1 | 2/2012 | Walker | |
| 2013/0000979 | A1 | 1/2013 | Le et al. | |
| 2013/0008655 | A1 | 1/2013 | Le et al. | |
| 2013/0224061 | A1 | 8/2013 | Walker | |

OTHER PUBLICATIONS

Restriction Requirement dated Nov. 29, 2012, U.S. Appl. No. 13/610,855, filed on Sep. 11, 2012.
Restriction Requirement dated Dec. 5, 2012, U.S. Appl. No. 13/104,014, filed May 9, 2011.
Notice of Allowance dated Dec. 6, 2012, U.S. Appl. No. 12/720,522, filed Mar. 9, 2010.
FAIPP Pre-Interview Communication dated Oct. 21, 2013, U.S. Appl. No. 13/610,853, filed Sep. 11, 2012.
Final Office Action dated Dec. 3, 2013, U.S. Appl. No. 13/563,719, filed Jul. 31, 2012.
Final Office Action dated Dec. 3, 2013, U.S. Appl. No. 13/857,145, filed Apr. 14, 2013.
Walker, Jerry L., "Patent Application entitled, High Density Powdered Material Liner", filed Apr. 4, 2013, U.S. Appl. No. 13/857,145.
Restriction Requirement dated Apr. 16, 2013, U.S. Appl. No. 13/104,014, filed May 9, 2011.
Restriction Requirement dated Apr. 18, 2013, U.S. Appl. No. 13/610,855, filed Sep. 11, 2012.
Supplemental Notice of Allowability dated Jan. 8, 2013, U.S. Appl. No. 12/720,522, filed Mar. 9, 2010.
Notice of Allowance dated Aug. 22, 2013, U.S. Appl. No. 13/104,014, filed May 9, 2011.
Restriction Requirement dated Jun. 7, 2013, U.S. Appl. No. 13/610,853, filed Sep. 11, 2012.
FAIPP Pre-Interview Communication dated Aug. 22, 2013, U.S. Appl. No. 13/610,855, filed Sep. 11, 2012.
FAIPP Pre-Interview Communication dated Jun. 14, 2013, U.S. Appl. No. 13/563,719, filed Jul. 31, 2012.
FAIPP Office Action dated Jul. 16, 2013, U.S. Appl. No. 13/563,719, filed Jul. 31, 2012.
FAIPP Pre-Interview Communication dated Jun. 11, 2013, U.S. Appl. No. 13/857,145, filed Apr. 14, 2013.
FAIPP Office Action dated Jul. 17, 2013, U.S. Appl. No. 13/857,145, filed Apr. 14, 2013.
Le, Cam Van, et al., Patent Application entitled, Perforating Gun Assembly and Method for Controlling Wellbore Pressure Regimes During Perforating, filed Sep. 11, 2012, U.S. Appl. No. 13/610,853.
Le, Cam Van, et al., Patent Application entitled, Perforating Gun Assembly and Method for Controlling Wellbore Pressure Regimes During Perforating, filed Sep. 11, 2012, U.S. Appl. No. 13/610,855.
Walker, Jerry L., Patent Application entitled, "High Density Powdered Material Liner", filed Jul. 31, 2012, U.S. Appl. No. 13/563,719.
Restriction Requirement dated Jul. 26, 2012, U.S. Appl. No. 13/104,014, filed May 9, 2011.
Office Action—Restriction Requirement dated Jul. 16, 2012, U.S. Appl. No. 12/720,522, filed Mar. 9, 2010.
Office Action dated Jul. 3, 2012, U.S. Appl. No. 13/128,094, filed Jul. 8, 2011.
Office Action dated May 26, 2011, U.S. Appl. No. 12/512,530, filed Jul. 30, 2009.
Office Action Restriction dated Nov. 25, 2011, U.S. Appl. No. 12/512,530, filed Jul. 30, 2009.
Office Action dated Apr. 13, 2012, U.S. Appl. No. 12/512,530, filed Jul. 30, 2009.
Office Action dated Dec. 21, 2011, U.S. Appl. No. 12/720,522, filed Mar. 9, 2010.
Atwood, D.C., et al., "Flow Performance of Perforation Tunnels Created with Shaped Charges Using Reactive Liner Technology," Society of Petroleum Engineers (SPE) European Formation Damage Conference, May 2009, The Netherlands.
Fischer, S.H., et al., "A Survey of Combustible Metals, Thermites, and Intermetallics for Pyrotechnic Applications," 32nd AIAA/ASME/SAE/ASEE Joint Propulsion Conference, Jul. 1996, Sandia National Laboratories, Albuquerque, NM, US.
Foreign Communication From a Related Counterpart Application—International Search Report and Written Opinion, PCT/US2010/039059, Mar. 30, 2011.
Foreign Communication From a Related Counterpart Application—International Search Report and Written Opinion, PCT/US2011/027638, Sep. 30, 2011.
Foreign Communication From a Related Counterpart Application—International Search Report and Written Opinion, PCT/US2011/036156, Feb. 17, 2012.
Le, Cam Van, et al., Patent Application entitled "Perforating Gun Assembly and Method for Controlling Wellbore Pressure Regimes During Perforating," filed May 9, 2011, U.S. Appl. No. 13/104,014.
Le, Cam Van, et al., PCT Application entitled "Perforating Gun Assembly and Method for Controlling Wellbore Pressure Regimes During Perforating," filed on May 11, 2011, Int'l. Application No. PCT/US11/36156.
Glenn, Corbin S., Patent Application entitled, "Shaped Charge Liner Comprised of Reactive Materials," filed Mar. 9, 2010, U.S. Appl. No. 12/720,522.

(56) References Cited

OTHER PUBLICATIONS

Glenn, Corbin S., PCT Application entitled, "Shaped Charge Liner Comprised of Reactive Materials," filed Mar. 9, 2011, Int'l. Application No. PCT/US11/27638.

Walker, Jerry L., Patent Application entitled "High Density Powdered Material Liner," filed May 6, 2011, U.S. Appl. No. 13/128,094.

Walker, Jerry L., PCT Application entitled "High Density Powdered Material Liner," filed Jun. 17, 2010, Int'l. Application No. PCT/US10/39059.

FAIPP Office Action dated Jan. 14, 2014, U.S. Appl. No. 13/610,855, filed Sep. 11, 2012.

Notice of Allowance dated Feb. 18, 2014, U.S. Appl. No. 13/857,145, filed Apr. 4, 2013.

Notice of Allowance dated Mar. 13, 2014, U.S. Appl. No. 13/610,853, filed on Sep. 11, 2012.

Notice of Allowance dated Feb. 18, 2014, U.S. Appl. No. 13/563,719, filed on Jul. 31, 2012.

* cited by examiner

SHAPED CHARGE LINER COMPRISED OF REACTIVE MATERIALS

CROSS-REFERENCE TO RELATED APPLICATIONS

The present application is a divisional of and claims priority to U.S. patent application Ser. No. 12/720,522 filed Mar. 9, 2010 and entitled "Shaped Charge Liner Comprised of Reactive Materials," which is incorporated herein by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons may be produced from wellbores drilled from the surface through a variety of producing and non-producing formations. The wellbore may be drilled substantially vertically or may be an offset well that is not vertical and has some amount of horizontal displacement from the surface entry point. In some cases, a multilateral well may be drilled comprising a plurality of wellbores drilled off of a main wellbore, each of which may be referred to as a lateral wellbore. Portions of lateral wellbores may be substantially horizontal to the surface. In some provinces, wellbores may be very deep, for example extending more than 10,000 feet from the surface.

A variety of servicing operations may be performed on a wellbore after it has been initially drilled. A lateral junction may be set in the wellbore at the intersection of two lateral wellbores and/or at the intersection of a lateral wellbore with the main wellbore. A casing string may be set and cemented in the wellbore. A liner may be hung in the casing string. The casing string may be perforated by firing a perforation gun or perforation tool. A packer may be set and a formation proximate to the wellbore may be hydraulically fractured. A plug may be set in the wellbore.

Perforation tools may comprise explosive charges that are detonated to fire the perforation tool, perforate a casing if present, and create perforations and/or tunnels into a subterranean formation proximate to the wellbore. It is desirable that the tunnels created in the subterranean formation be deep and as free of debris as possible to promote flow of fluids into or out of the subterranean formation. Debris may comprise fines released from the subterranean formation or created by the perforation and/or residue from the perforation tool, for example, metal shards blown out of the perforation tool by the explosive charges.

SUMMARY

In an embodiment, a shaped charge liner is provided. The shaped charge liner comprises a first material denser than 10 grams per cubic centimeter (g/cc) and a reactive material. The first material is concentrated in a middle of the liner and decreased in at least one of an apex and a skirt of the liner, and the reactive material is concentrated in at least one of the apex and the skirt of the liner and decreased in the middle of the liner.

In another embodiment, a shaped charge liner is disclosed. The shaped charge liner comprises powder, wherein the powder comprises a blend of particles, wherein the particles comprise a core material, a first reactant material in intimate contact with the core material, and a second reactant material in intimate contact with the first reactant, wherein the core material has a density greater than 10 grams per cubic centimeter (g/cc).

In another embodiment, a downhole perforation tool is disclosed. The downhole perforation tool comprises a plurality of shaped explosive charges, wherein the shaped explosive charges comprise a shaped charge defining a cup and a shaped charge liner fitting inside the cup defined by the shaped explosive charge, wherein the shaped charge liner is comprised of a first material and a reactive material. The first material is denser than 10 grams per cubic centimeter (g/cc), and the reactive material comprises two complementary reactive materials. The first material is concentrated in a middle of the liner and decreased in at least one of an apex and a skirt of the liner, and the reactive material is concentrated in at least one of the apex and the skirt of the liner and decreased in the middle of the liner.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
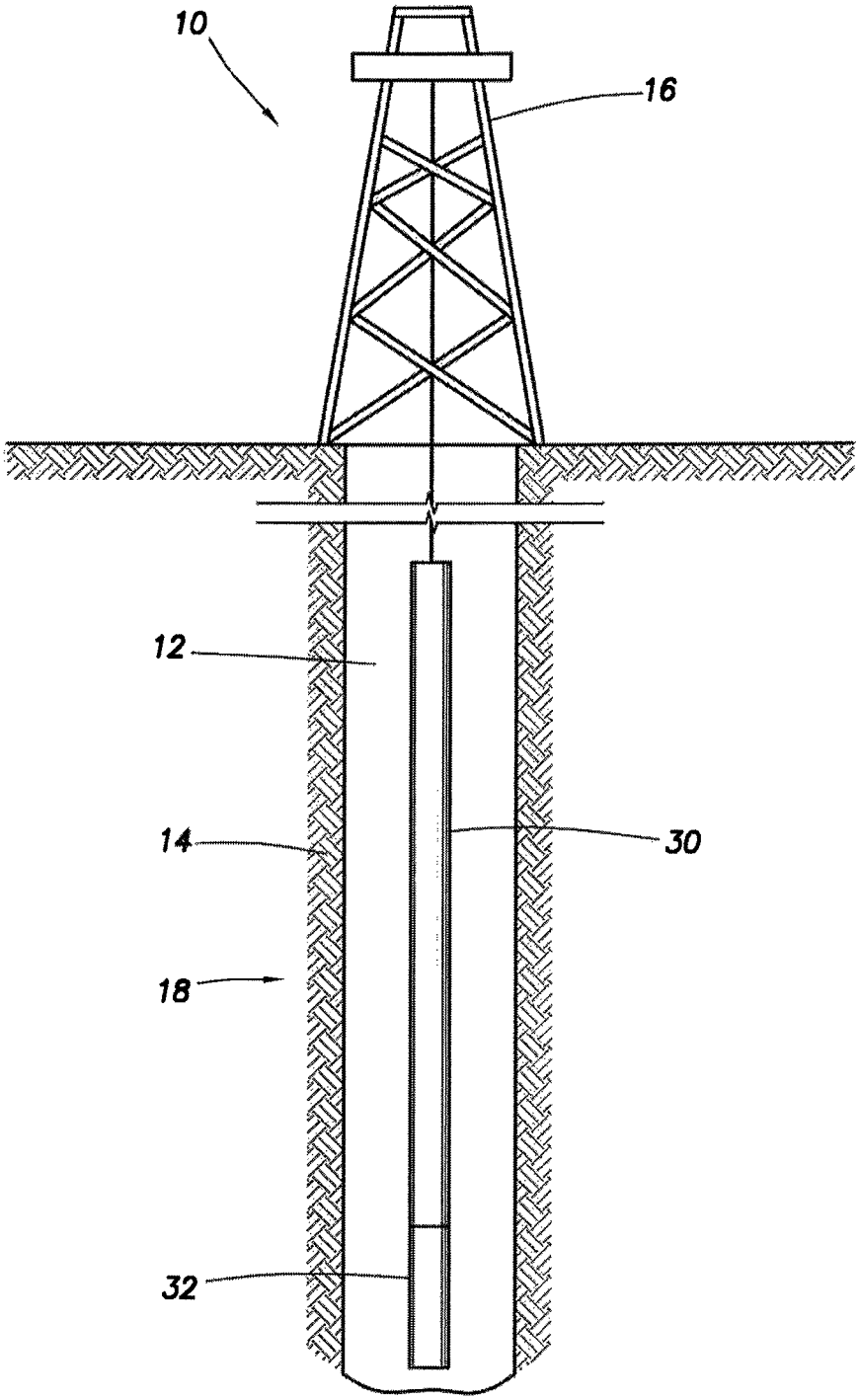
FIG. 1 is an illustration of a wellbore, a conveyance, and a perforation tool according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Liners for shaped explosive charges in perforation tools may collapse and develop a high speed jet creating tunnels in a subterranean formation during a perforation event. Such liners may be referred to as shaped charge liners. It may be desirable for at least a portion of the shaped charge liner to comprise a dense material that is present in this high speed jet. The energy that is thus transferred to the dense material may be more effectively concentrated to promote deeper tunnels. It has been observed that some portions of the liner may trail behind the leading edge of the jet and hence may be a small contributor to the creation of tunnels in the subterranean formation. These portions may be referred to as a slug. The slug may degrade the condition of the tunnel, for example at least partially clogging and/or plugging the tunnel.

The present disclosure teaches a shaped charge liner comprising a dense material component and a reactive materials component. The dense material provides the penetrating action described above. The reactive materials react to the heat and/or pressure created by the detonation of the shaped charges to at least partially transform from a solid state to a gaseous state, for example through an energetic chemical reaction. The reaction of the reactive materials may promote two separate behaviors, both of which may be desirable. By at least partially consuming the reactive materials, the mass of the slug which remains after the perforation has been completed and the wellbore has reached a steady state is reduced and hence exhibits less of a deleterious clogging effect on the tunnels. Additionally, as a result of the energetic reaction of the reactive materials, a pressure differential may be created between the outer ends of the tunnel and the wellbore which may help to sweep debris out of the tunnels.

In an embodiment, the dense material and the reactive materials are distributed unequally in the shaped charge liner so that the dense material is concentrated in a middle band of the shaped charge liner that contributes most significantly to the formation of the jet and the reactive materials are concentrated in at least one of a skirt portion or a skirt area of the shaped charge liner (an outer edge closest to the exterior of the perforation tool) and in an apex portion or a skirt area of the shaped charge liner, both of which portions contribute most significantly to the formation of the slug. In one case, the shaped charge liner may be formed of two layers and/or laminations, wherein the reactive materials layer is thinner in the middle band and thicker in at least one of an apex portion and a skirt portion of the reactive materials layer, and wherein the dense material layer is thicker in the middle band and thinner in at least one of the apex and the skirt portions of the dense material layer. In another case, the shaped charge liner may be formed of a middle band consisting essentially of the dense material and an apex portion and a skirt portion consisting essentially of the reactive materials. It is understood that both the dense material and the reactive materials, in either case, may be mixed with an effective amount of material to serve purposes secondary to penetrating the formation and back flushing the perforations and/or tunnels created in the formation, for example waxes, binders, and anti-static agents to promote compressing the dense and reactive materials in powdered form to manufacture the shaped charge liner; sealing layers to protect the dense and reactive materials; and supporting layers to promote maintaining the structural integrity of the shaped charge liner. In another embodiment, the dense material forms an inner core of a powder particle, a first reactant is coated over the dense material to form an intermediate shell of the powder particle, and a second reactant is coated over the first reactant to form an outer shell of the powder particle. The shaped charge liner may then be formed out of the powder particles by pressing the powder into the appropriate form.

Turning now to FIG. 1, a wellbore servicing system 10 is described. The system 10 comprises a servicing rig 16 that extends over and around a wellbore 12 that penetrates a subterranean formation 14 for the purpose of recovering hydrocarbons, storing hydrocarbons, disposing of carbon dioxide, or the like. The wellbore 12 may be drilled into the subterranean formation 14 using any suitable drilling technique. While shown as extending vertically from the surface in FIG. 1, in some embodiments the wellbore 12 may be deviated, horizontal, and/or curved over at least some portions of the wellbore 12. The wellbore 12 may be cased, open hole, contain tubing, and may generally comprise a hole in the ground having a variety of shapes and/or geometries as is known to those of skill in the art.

The servicing rig 16 may be one of a drilling rig, a completion rig, a workover rig, a servicing rig, or other mast structure and supports a workstring 18 in the wellbore 12, but in other embodiments a different structure may support the workstring 18, for example an injector head of a coiled tubing rigup. In an embodiment, the servicing rig 16 may comprise a derrick with a rig floor through which the workstring 18 extends downward from the servicing rig 16 into the wellbore 12. In some embodiments, such as in an off-shore location, the servicing rig 16 may be supported by piers extending downwards to a seabed. Alternatively, in some embodiments, the servicing rig 16 may be supported by columns sitting on hulls and/or pontoons that are ballasted below the water surface, which may be referred to as a semi-submersible platform or rig. In an off-shore location, a casing may extend from the servicing rig 16 to exclude sea water and contain drilling fluid returns. It is understood that other mechanical mechanisms, not shown, may control the run-in and withdrawal of the workstring 18 in the wellbore 12, for example a draw works coupled to a hoisting apparatus, a slickline unit or a wireline unit including a winching apparatus, another servicing vehicle, a coiled tubing unit, and/or other apparatus.

In an embodiment, the workstring 18 may comprise a conveyance 30, a perforation tool 32, and other tools and/or subassemblies (not shown) located above or below the perforation tool 32. The conveyance 30 may comprise any of a string of jointed pipes, a slickline, a coiled tubing, a wireline, and other conveyances for the perforation tool 32. In an embodiment, the perforation tool 32 comprises one or more explosive charges that may be triggered to explode, perforating a casing if present, perforating a wall of the wellbore 12 and forming perforations or tunnels out into the formation 14. The perforating may promote recovering hydrocarbons from the formation 14 for production at the surface, storing hydrocarbons flowed into the formation 14, or disposing of carbon dioxide in the formation 14, or the like.

Figure 2:
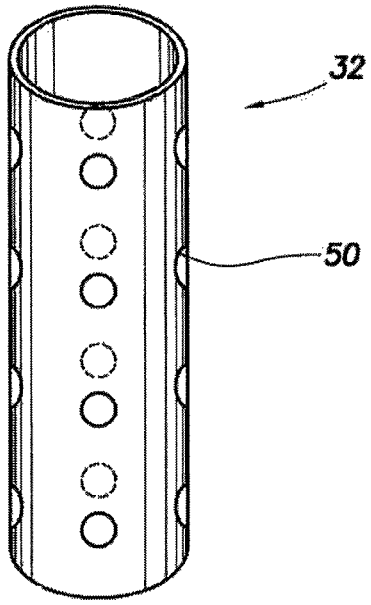
FIG. 2 is an illustration of a perforation tool according to an embodiment of the disclosure.

Turning now to FIG. 2, the perforation tool 32 is described. The perforation tool 32 comprises one or more explosive charge assemblies 50. The perforation tool 32 may comprise a tool body (not shown) that contains the explosive charge assemblies 50 and protects and seals them from the downhole environment prior to perforation. A surface of the tool body may be bored and/or countersunk proximate to the explosive charge assemblies 50 to promote ease of perforation of the tool body by detonation of the explosive charge assemblies 50. The bored and/or countersunk surface may be referred to as scalloping. The tool body may be constructed out of various metal materials as are known to those skilled in the art. The tool body may be constructed of one or more kinds of steel including stainless steel, chromium steel, and other steels. Alternatively, the tool body may be constructed of other non-steel metals or metal alloys.

The explosive charge assemblies 50 may be disposed in a first plane perpendicular to the axis of the tool body, and additional planes or rows of additional explosive charge assemblies 50 may be positioned above and below the first plane. In an embodiment, four explosive charge assemblies 50 may be located in the same plane perpendicular to the axis of the tool body, 90 degrees apart. In an embodiment, three explosive charge assemblies 50 may be located in the same plane perpendicular to the axis of the tool body, 120 degrees apart. In other embodiments, however, more explosive charge assemblies may be located in the same plane perpendicular to the axis of the tool body. The direction of the explosive charge assemblies 50 may be offset by about 45 degrees between the first plane and a second plane, to promote more densely arranging the explosive charge assemblies 50 within the tool body. The direction of the explosive charge assemblies 50 may be offset by about 60 degrees between the first plane and a second plane, to promote more densely arranging the explosive charge assemblies 50 within the tool body.

In an embodiment, a frame structure (not shown) that retains the explosive charge assemblies 50 in planes, oriented in a preferred direction, and with appropriate angular relationships between rows, is disposed within the tool body. In an embodiment, a detonator cord couples to each of the explosive charge assemblies 50 to detonate the explosive charge assemblies 50. When the perforation tool 32 comprises multiple planes and/or rows of explosive charge assemblies 50, the detonator chord may be disposed on the center axis of the tool body. The detonator chord may couple to a detonator apparatus that is triggered by an electrical signal or a mechanical impulse or by another trigger signal. When the detonator activates, a detonation propagates through the detonation chord to each of the explosive charge assemblies 50 to detonate each of the explosive charge assemblies 50 substantially at the same time.

Figure 3:
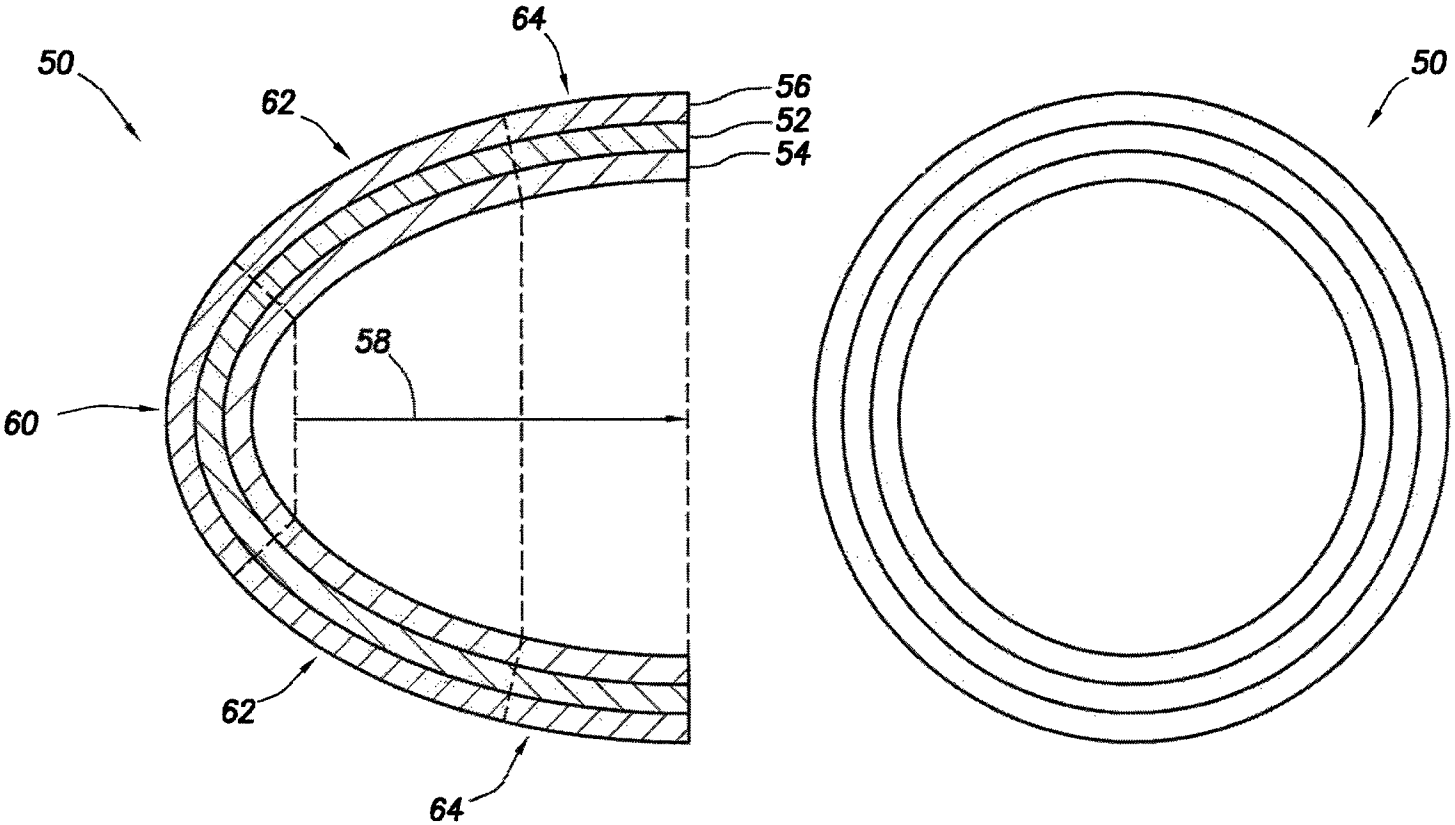
FIG. 3 is an illustration of a shaped explosive charge assembly according to an embodiment of the disclosure.

Turning now to FIG. 3, further details of the explosive charge assembly 50 are described. The explosive charge assembly 50 comprises a shaped explosive charge 52 and a first shaped charge liner 54. In an embodiment, the explosive charge assembly 50 may further comprise a shaped charge housing 56. The shaped explosive charge 52 is designed to focus explosive energy in a preferred direction, for example in the direction of an explosive focus axis 58. The shaped explosive charge 52, the first shaped charge liner 54, and the shaped charge housing 56 may nest generally as illustrated in FIG. 3 and may each take the general form of a solid of revolution defined by a half-ellipse, a portion of a parabola, a portion of a hyperbola, a half circle, or some other shape. The shaped explosive charges 52, the first shaped charge liner 54, and the shaped charge housing 56 may take the general form of a solid of revolution defined by a polygon. The shaped explosive charge 52, the first shaped charge liner 54, and the shaped charge housing 56 may take the general shape of a cup or of half of an egg shell. In an embodiment, rather than taking the general form of a solid of revolution, the shaped explosive charge 52, the first shaped charge liner 54, and the shaped charge housing 56 may take a generally cup shaped form defined by a plurality of portions of planes. The explosive charge assembly 50—and each of the shaped explosive charge 52, the first shaped charge liner 54, and the shaped charge housing 56—conceptually may be divided into a first apex area 60, a first middle area or first middle band 62, and a first skirt area or first skirt band 64. It is understood that this segmentation of the explosive charge assembly 50 is conceptual and not physical and is provided to help clarify descriptions further below.

Figure 4:
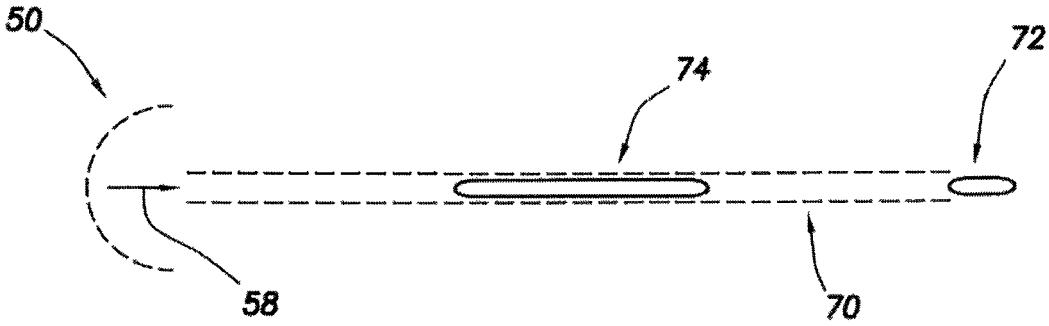
FIG. 4 is an illustration of an explosive jet penetrating a subterranean formation according to an embodiment of the disclosure.

Turning now to FIG. 4, a detonation jet of the explosive charge assembly 50 is described. When the shaped explosive charge 52 is detonated, for example by the propagation of a detonation from the detonator cord to the shaped explosive charge 52, the energy of the detonation is preferably concentrated and/or focused along the explosive focus axis 58, forming a detonation jet 70 indicated by the dotted line. A portion of the first shaped charge liner 54 may form a projectile 72 that is accelerated by the energy of detonation and forms the leading edge of the detonation jet 70 as it penetrates into the subterranean formation 14 creating a perforation and/or tunnel in the subterranean formation 14. The projectile 72 preferably comprises dense material that may penetrate more effectively than less dense material. Another portion of the first shaped charge liner 54 may form a slug 74 that moves more slowly and lags behind the projectile 72. It is thought that the slug 74 does not assist substantially in the penetration of the subterranean formation 14 and instead contributes to fouling the perforation and/or tunnel by plugging flow paths.

Generally, the first middle band 62 of the first shaped charge liner 54 contributes most of the material forming the projectile 72. The first apex area 60 and the first skirt area 64 of the first shaped charge liner 54 contribute most of the material forming the slug 74. It is one of the teachings of the present disclosure that the first shaped charge liner 54 may comprise a combination of dense material distributed in a greater concentration in the first middle band 62 of the first shaped charge liner 54 and a reactive group of material distributed in a greater concentration in at least one of the first apex area 60 and in the first skirt area 64 of the first shaped charge liner 54. The reactive group may comprise two or more complementary reactive materials. This unequal distribution by location of dense material and the reactive materials throughout the first shaped charge liner 54 tends to promote the dense material forming the projectile 72, thereby promoting deeper penetration of the subterranean formation 14, and to promote the reactive group of material forming the slug 74. In some contexts the reactive group may be referred to as a reactive material, for example a reactive material comprised of two complementary reactive materials.

The reactive group of materials reacts energetically in response to the high pressure and/or heat of the detonation. The energetic reaction of the reactive group of materials occurs at a slower rate than the detonation and propagation of the detonation jet 70. For example, the detonation and perforation of the subterranean formation 14 may be completed in about 50 microseconds while the energetic reaction of the reactive group of materials may be completed in about 1 millisecond or even longer. It is understood that the energetic reaction may begin substantially concurrently with detonation of the shaped explosive charge 52, but due to the slow reaction of the reactive group of materials relative to the detonation event, the reaction may only have completed about one-tenth of its reaction or less by the time the detonation event is complete. Hence, the reactive group of materials are expelled out into the tunnel formed by the detonation of the shaped explosive charge 52 before the most of the energetic reaction occurs. The energetic reaction of the reactive group may cause high pressure in the interior of the perforation and/or tunnel that induces a flow of fluid—for example fluids flowing out of the subterranean formation 14, wellbore fluids, and/or gases released by the energetic reaction of the reaction group materials—that helps to flush debris out of the perforation and/or tunnel. Additionally, the energetic reaction of the reactive group may transform the energetic group materials from the slug material that tends to clog and/or plug up the perforation and/or tunnel into a gas that reduces or eliminates clogging and/or plugging of the perforation and/or tunnel.

Figure 5:
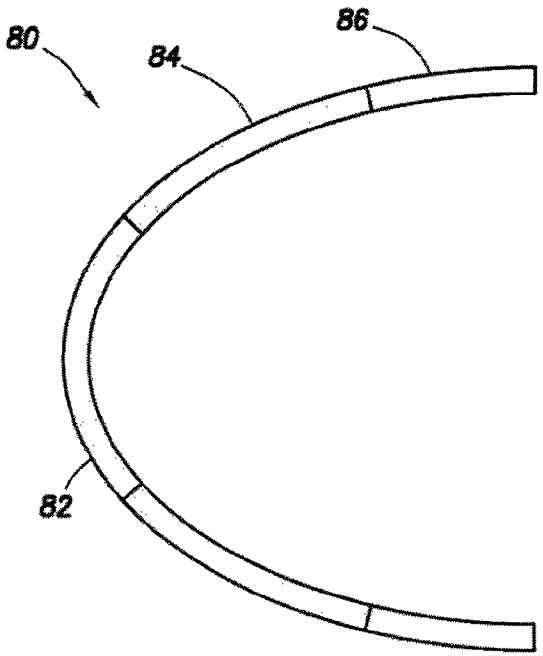
FIG. 5 is an illustration of a shaped charge liner according to an embodiment of the disclosure.

Turning now to FIG. 5, an embodiment of a second shaped charge liner 80 is described. The second shaped charge liner 80 comprises a second apex area 82 comprised of a reactive group materials, a second middle band 84 comprised of a dense material, and a second skirt area 86 comprised of the reactive group materials. The dense material may be denser than 10 grams per cubic centimeter (g/cc). In an embodiment, the dense material may comprise tungsten, tantalum, lead, gold, and/or depleted uranium. It is understood that other dense materials not explicitly enumerated above are also contemplated by the present disclosure. In some contexts, the reactive group materials may be referred to as reactive material.

In an embodiment, the dense material may comprise a reactive group of dense materials, for example tantalum and tungsten dioxide ($WO_2$). The dense reactive group would comprise a dense projectile 72 that promotes deep penetration and would also contribute to flushing the tunnels as a result of their energetic reaction. The expense of tantalum may be a practical consideration for this embodiment. By not using the dense reactive group throughout the second shaped charge liner 80 but reserving this higher cost material to the second middle band 84 may contribute to cost containment. Less dense reactive group materials may be used in the second apex area 82 and the second skirt area 86 which do not significantly contribute to the projectile 72. Alternatively, the dense material may comprise a dense material in the second middle band 84 and comprise a reactive group of dense materials, for example tantalum and tungsten dioxide, in the second skirt area 86 and/or the second apex area 82.

The reactive group materials may comprise thermite mixtures, intermetallic reactants, and/or other reactants. Generally, a thermite is a mixture of a metal and an oxidizer, for example a metal oxide, that react to give off heat under specific conditions, for example when triggered by heat and/or pressure. Some thermite reactive groups, however, may comprise a metal and a non-metallic oxide, for example aluminum (Al) and silicon dioxide ($SiO_2$) can undergo a thermitic reaction. Generally, intermetallic reactants comprise selected pairs of metals that react together under specific conditions, for example when triggered by heat and/or pressure. Some intermetallic reactive groups, however, may comprise a metal and a non-metal, for example boron (B) and silicon (Si) can undergo an intermetallic reaction. As an alternative way of understanding intermetallic reactive groups, under some conditions some chemists may consider boron, carbon, and silicon to be metallic or to behave under subject conditions in a manner that a metal would. Some of the reactive group materials may comprise pairs of materials that, when in intimate contact and effectively stimulated by high temperature and/or high pressure, react energetically with each other. The reactive group materials may comprise nickel paired with aluminum and/or tantalum paired with aluminum. The reactive group materials may comprise tantalum and an oxidizer, for example tantalum paired with iron oxide ($Fe_2O_3$), tantalum paired with copper oxide ($Cu_2O$), and/or tantalum paired with tungsten dioxide ($WO_2$). The reactive group materials may comprise neodymium and an oxidizer, for example neodymium paired with lead oxide (for example, $PbO_2$ or $Pb_3O_4$). It is understood that other reactive group materials not explicitly enumerated above are also contemplated by the present disclosure. For further enumeration of reactive group materials, see *A Survey of Combustible Metals, Thermites, and Intermetallics for Pyrotechnic Applications*, a paper by S. H. Fischer and M. G. Grubelich, presented at the 32$^{nd}$ AIAA/ASME/SAE/ASEE Joint Propulsion Conference, Lake Buena Vista, Fla., Jul. 1-3, 1996, which is hereby incorporated in its entirely by reference for all purposes. The reaction efficiency of some reactant pairs, for example the nickel-aluminum reactive group, may be sensitive to the stoichiometric mix of the reactants and/or the homogeneity of the mix of the reactants. The relative quantities of the reactants may be selected to assure an effective stoichiometric mix of the reactants.

The second apex area 82 may comprise about one-third of the second shaped charge liner 80, the second middle band 84 may comprise about one-third of the second shaped charge liner 80, and the second skirt area 86 may comprise about one-third of the second shaped charge liner 80. Alternatively, the second apex area 82 may comprise about one-fourth, the second middle band 84 may comprise about one-half, and the second skirt area 86 may comprise about one-fourth of the second shaped charge liner 80. Alternatively, the second apex area 82 may comprise about one-fifth, the second middle band 84 may comprise about two-fifths, and the second skirt area 86 may comprise about two-fifths of the second shaped charge liner 80. In another embodiment, the proportions among the second apex area 82, the second middle band 84, and the second skirt area 86 may be different. In some contexts it may be said that the ratio of dense material to the reactive group materials in the second middle band 84 is greater than the ratio of dense material to the reactive group materials in the second apex area 82. Additionally, in some contexts it may be said that the ratio of dense material to the reactive group materials in the second middle band 84 is greater than the ratio of dense material to the reactive group materials in the second skirt area 86.

The dense material and the reactive group materials may be supplied in the form of powders that are selectively pressed together to form the second shaped charge liner 70. In an embodiment, an admixture of malleable metal may be combined with the dense material to promote the holding together of the dense material. The pressed powders hold together by the Green Strength properties of the subject powders.

Figure 6:
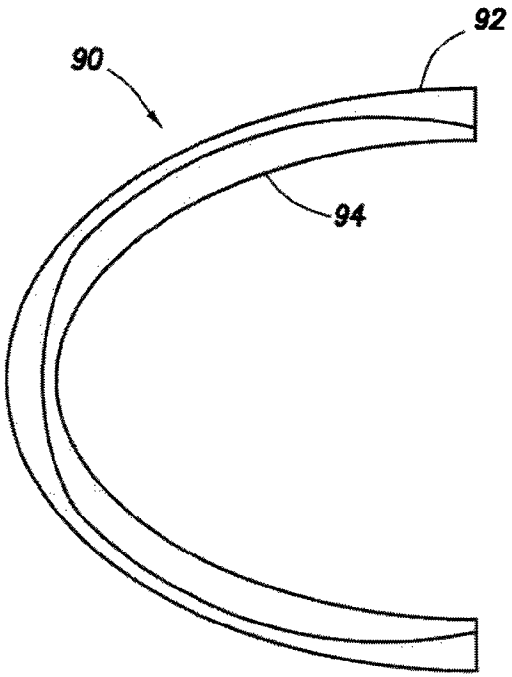
FIG. 6 is an illustration of another shaped charge liner according to an embodiment of the disclosure.

Turning now to FIG. 6, another embodiment of a third shaped charge liner 90 is described. The third shaped charge liner 90 comprises an inner layer 94 comprised of the dense material coupled to an outer layer 92 comprised of the reactive group materials. In some contexts, the third shaped charge liner 90 may be said to be laminated and/or to be a laminated charge liner. Note that the distribution of dense material and of reactive group materials is not uniform throughout the third shaped charge liner 90. The inner layer 94 is thick and the outer layer 92 is thin in an area corresponding to the first middle band 62 of FIG. 3. The inner layer 94 is thin and the outer layer 92 is thick in the areas corresponding to the first apex area 60 and the first skirt area 64 of FIG. 3. In some contexts it may be said that the ratio of dense material to the reactive group materials in the area of the third shaped charge liner 90 corresponding to the first middle band 62 of FIG. 3 is greater than the ratio of dense material to the reactive group materials in the area of the shaped charge liner 90 corresponding to the first apex area 60 of FIG. 3. Additionally, in some contexts it may be said that the ratio of dense material to the reactive group materials in the area of the third shaped charge liner 90 corresponding to the first middle band 62 in FIG. 3 is greater than the ratio of dense material to the reactive group materials in the area of the third shaped charge liner 90 corresponding to the first skirt area 64 in FIG. 3. The first apex area 60 of the third shaped charge liner 90 where the inner layer 94 is thin and the outer layer 92 is thick, the first middle band 62 of the third shaped charge liner 90 where the inner layer 94 is thick and the outer layer 92 is thin, and the first skirt area 64 of the third shaped charge liner 90 where the inner layer 94 is thin and the outer layer 92 is thick may be distributed in the variety of proportions of the first apex area 60, the first middle band 62, and the first skirt area 64 described above with reference to the first shaped charge liner 54.

In alternative embodiments, the thickness of the outer layer 92 and the inner layer 94 may be different than that described above. In an embodiment, the outer layer 92 may be thick in only the first apex area 60 and thin in both the first middle band 62 and the first skirt area 64; while the inner layer 94 is thin only in the first apex area 60 and thick in both the first middle band 62 and the first skirt area 64. In another embodiment, the outer layer 92 may be thick only in the first skirt area 64 and thin in both the first middle band 62 and the first apex area 60; while the inner layer 94 is thin only in the first skirt area 64 and thick in both the first middle band 62 and the first apex area 60. In an embodiment, the outer layer 92 may be thick in both the first apex area 60 and the first skirt area 64; while the inner layer 94 is thin only in the first apex area 60 and thick in both the first middle band 62 and the first skirt area 64. In an embodiment, the outer layer 92 may be thick in both the first apex area 60 and the first skirt area 64; while the inner layer 94 is thin only in the first skirt area 64 and thick in both the first middle band 62 and the first apex area 60.

In an alternative embodiment, the outer layer 92 may comprise the dense material and the inner layer 94 may be comprised of the reactive group materials. In this case, the first middle band 62 of the outer layer 92 would be thick while the first middle band 62 of the inner layer 94 would be thin.

Because the first middle band 62 contributes most to the formation of the projectile 72, the dense material of the inner layer 94 contributes most to the formation of the projectile 72. Likewise, because the first apex area 60 and the first skirt area 64 contribute most to the formation of the slug 74, the reactive group materials contribute most to the formation of the slug 74. The dense material may be the same material discussed above with reference to FIG. 5. The reactive group materials may be the same materials discussed above with reference to FIG. 5. The relative quantities of the reactants in the outer layer 92 may be selected to assure an effective stoichiometric mix of the reactants.

The dense material may be obtained in the form of a powder that is pressed into the form of the inner layer 94. In an embodiment, the dense material may be mixed with an admixture of malleable metal that promotes the holding together of the pressed dense material by green strength. For example, the dense material may be mixed with copper, lead, and/or another malleable material. The reactive group materials may be supplied in the form of powders that are pressed together to form the outer layer 92. In an embodiment, one of the two layers 92, 94 may be formed first and then the remaining layer may be formed by pressing into the first formed layer. The third shaped charge liner 90 may provide greater ease of manufacturing than the second shaped charge liner 80, but both embodiments are contemplated to be effective and useful. The reactive group materials may be mixed with an admixture of malleable metal that promotes the holding together of the pressed reactive group materials by green strength. For example, the reactive group materials may be mixed with copper, lead, and/or another malleable material.

Figure 7:
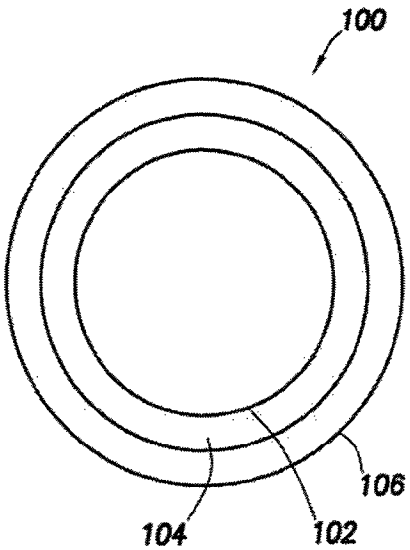
FIG. 7 is an illustration of a powder material suitable for forming a shaped charge linear according to an embodiment of the disclosure.

Turning now to FIG. 7, a composition 100 is described. The composition 100 comprises a core material 102 comprising a dense material, a first reactant material 104 in intimate contact with the core material 102, and a second reactant material 106 in intimate contact with the first reactant material 104. The core material 102 may have a density greater than 10 g/cc. One of the reactant materials 104, 106 is a metal and the other reactant is one of a metal and a metal oxide. The composition 100 may be provided in powder form and is suitable for pressing into the form of an explosive charge liner, for example the first shaped charge liner 54 of FIG. 3. The particles and/or granules of the composition 100 may have a diameter less than 500 microns, less than 100 microns, less than 20 microns, or less than 1 micron.

The core material 102 may be tungsten, tantalum, lead, gold, depleted uranium, and/or another material denser than 10 g/cc. The reactant materials 104, 106 may comprise a thermite mixture. The reactant materials 104, 106 may comprise intermetallic reactants. The reactant materials 104, 106 may comprise other reactants. The reactant materials 104, 106 may comprise nickel paired with aluminum, tantalum paired with iron oxide ($Fe_2O_3$), tantalum paired with copper oxide (CuO), tantalum paired with tungsten dioxide ($WO_2$), and/or other pairs of materials. The reactant materials 104, 106 may be coated over the core material 102 in a controlled process that assures an effective proportion of between the first reactant material and the second reactant material to provide a suitable stoichiometric mix. Additionally, the controlled process can further assure the appropriate proportion between the stoichiometric mix of reactant materials 104, 106 to the core material 102 to achieve effective perforation of the subterranean formation 14. The reaction efficiency of some reactant pairs, for example the nickel-aluminum reactive group, may be sensitive to the stoichiometric mix of the reactants and/or the homogeneity of the mix of the reactants. The controlled process provides for the homogeneity of the mix of the reactants. In an embodiment, one or more of the core material 102, and the reactant materials 104, 106 may include an admixture of other material to promote the coating of the first reactant material 104 over the core material 102 and/or of the second reactant material 106 over the first reactant material 106. In an alternative embodiment, for example when the core material 102 and the reactant materials 104, 106 coat without the assistance of an admixture of other material, there may be no admixture of other materials.

In an embodiment, the idea of the composition 100 may be combined with the ideas of a first shaped charge liner 54 with uneven distribution between the apex portion, skirt portion, and middle band of the shaped charge liner. For example, the composition 100 may be produced as a first variant having relatively less core material 102 and relatively more reactant materials 104, 106 and in a second variant having relatively more core material 102 and relatively less reactant materials 104, 106. The first shaped charge liner 54 may then be formed by pressing the powders of the first variant and the second variant together, where there is a greater concentration of the powder of the first variant and a lesser concentration of the powder of the second variant in the apex portion and skirt portion of the first shaped charge liner 54 and where there is a greater concentration of the powder of the second variant and a lesser concentration of the powder of the first variant in the middle band of the first shaped charge liner 54.

Alternatively, the composition 100 may be combined with second composition that is made by using a first reactive material as the core material and having a second reactive material layered over the first reactive material to form the first shaped charge liner 54. The first shaped charge liner 54 may be formed by pressing the powders of the composition 100 together with powders of the second composition, where there is a greater concentration of second composition powder and a lesser concentration of the composition 100 powder in the first apex area 60 and the first skirt area 64 of the first shaped charge liner 54 and where there is a greater concentration of the composition 100 powder and a lesser concentration of the second composition powder in the first middle band 62 of the first shaped charge liner 54.

Alternatively, a third composition that is made by using a first reactive material as the core material, wherein the first reactive material is a dense material having density greater than 10 g/cc, and having a second reactive material layered over the first reactive material to form the first shaped charge liner 54 may be combined with a fourth composition that is made by using a third reactive material as the core material and a fourth reactive material layered over the third reactive material, wherein the third and fourth reactive materials are less dense than 10 g/cc. Thus, the third composition promotes both penetration and post-detonation reaction to consume, at least in part, the residue of the third composition in the perforation and/or tunnel created by perforation as well as to promote back flushing the tunnel, and the fourth composition primarily promotes back flushing the tunnel. The first shaped charge liner 54 may be formed by pressing the powders of the third composition together with powders of the fourth composition, where there is a greater concentration of fourth composition powder and a lesser concentration of the third composition powder in the first apex area 60 and first skirt area 64 of the first shaped charge liner 54 and where there is a greater concentration of the third composition powder and a lesser concentration of the fourth composition powder in the first middle band 62 of the first shaped charge liner 54. In some cases, the first reactive material may be a relatively expensive material, for example tantalum (Ta), and the design for the first shaped charge liner 54 that reduces the amount of the first reactive material used to fabricate the first shaped charge liner 54, by distributing the third composition powder and the fourth composition powder as described above, may desirably reduce material costs relative to a design that uses only the first reactive material throughout the first shaped charge liner 54.

With all of the above, while some embodiments discussed were described as having different combinations of materials more or less concentrated in different regions or portions of the first shaped charge liner 54, in some other embodiments some regions could exclude or substantially exclude some of the combinations of materials (i.e., unmixed over this region or regions). Also, it is understood the reactive materials and/or the dense materials may be combined with other materials serving purposes secondary to the main purpose of encouraging deep penetration into the subterranean formation 14 and leaving the tunnels so formed unclogged, for example waxes, binders, and anti-static agents to promote ease of manufacturing; sealing layers to protect the shaped charge liners 54, 80, 90; supporting layers to promote the structural integrity of the shaped charge liners 54 which otherwise may be brittle and/or frangible. In some cases, a relatively small amount of malleable metal powder may be mixed with one or more of the materials to reduce tooling wear and/or to promote the ability of the pressed powders to hold together by green strength, for example one or more of copper, lead, and other malleable materials.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A shaped charge liner, comprising:

an apex portion;

a skirt portion;

a middle band disposed between the apex portion and the skirt portion a first powder composition comprising particles that comprise a core material, and a first reactant material coated on the core material, wherein the core material has a density greater than about 10 grams per cubic centimeter (g/cc); and a second powder composition comprising particles that comprise a second reactant material, and a third reactant material coated on the second reactant material, wherein the apex portion, the skirt portion, and the middle band comprise a mixture of the first powder composition and the second powder composition, and wherein the concentration of first powder composition is greater in the middle band than the apex portion or the skirt portion.

2. The shaped charge liner of claim 1, wherein the core material comprises a reactant material.

3. The shaped charge liner of claim 2, wherein the second reactant material has a density less than or equal to about 10 grams per cubic centimeter (g/cc).

4. The shaped charge liner of claim 1, where the first powder composition further comprises a fourth reactant material coated on the first reactant material.

5. The shaped charge liner of claim 4, wherein the second powder composition comprises a second core material, wherein the second reactant material is coated on the second core material, wherein the second core material has a density greater than 10 grams per cubic centimeter (g/cc), and wherein the concentration of the second core material in the second powder composition is less than the concentration of the core material in the first powder composition.

6. The shaped charge liner of claim 5, where the fourth reactant material and the third reactant material are the same, and wherein the first reactant material and the second reactant material are the same.

7. The shaped charge liner of claim 1, wherein the particles of the first powder composition have a diameter of less than about 500 microns.

8. The shaped charge liner of claim 1, wherein the core material comprises a material selected from the group consisting of: tungsten, tantalum, lead, gold, depleted uranium, and any combination thereof.

9. The shaped charge liner of claim 1, wherein the first reactant material comprise a material selected from the group consisting of: nickel paired with aluminum, tantalum paired with iron oxide, tantalum paired with copper oxide, and tantalum paired with tungsten dioxide.

10. The shaped charge liner of claim 1, wherein the first reactant material comprises a material selected from the group consisting of: a thermite mixture, and intermetallic reactants.

11. The shaped charge liner of claim 1, wherein the second reactant material comprises a material selected from the group consisting of: a thermite mixture, and intermetallic reactants.

12. The shaped charge of claim 1, wherein a fourth reactant material is in intimate contact with the third reactant material.

13. The shaped charge liner of claim 12, wherein the third reactant material coated on the second reactant material forms an intermediate shell of the particles, and wherein the fourth reactant material in intimate contact with the third reactant material forms an outer shell of the particles.

14. The shaped charge liner of claim 1, wherein the core material, the first reactant material, the second reactant material, and the third reactant material comprise a material selected from the group consisting of: nickel paired with aluminum, tantalum paired with iron oxide, tantalum paired with copper oxide, and tantalum paired with tungsten dioxide.

15. The shaped charge liner of claim 1, wherein the core material, the first reactant material, the second reactant material, and the third reactant material comprise a material selected from the group consisting of: a thermite mixture, and intermetallic reactants.

16. The shaped charge liner of claim 1, wherein the core material, the first reactant material, the second reactant material, and the third reactant material comprise a stoichiometric mix of the first reactant material and the second reactant material.

17. The shaped charge liner of claim 1, wherein the first reactant material comprises a metal, and wherein the second reactant material comprises a metal oxide.

18. The shaped charge liner of claim 1, wherein the first reactant material comprises a metal oxide, and wherein the second reactant material comprises a metal.

* * * * *